US005555075A

United States Patent [19]

Fukano et al.

[11] Patent Number: 5,555,075

[45] Date of Patent: Sep. 10, 1996

[54] FIXATION TEMPERATURE CONTROL DEVICE

[75] Inventors: Masahiko Fukano; Toshiyuki Nakade; Hiroshi Kageyama, all of Osaka, Japan

[73] Assignee: Mita Industrial Co., Ltd., Osaka, Japan

[21] Appl. No.: 569,979

[22] Filed: Dec. 8, 1995

[30] Foreign Application Priority Data

Jan. 11, 1995 [JP] Japan ..... 7-002878
Jan. 11, 1995 [JP] Japan ..... 7-002879

[51] Int. Cl.[6] ..... G03G 15/20

[52] U.S. Cl. ..... 355/208; 355/30; 355/285; 219/216; 219/494

[58] Field of Search ..... 355/208, 285, 355/30; 219/216, 490, 494

[56] References Cited

U.S. PATENT DOCUMENTS 4,609,278 9/1986 Taniguchi ..... 355/285
4,905,051 2/1990 Satoh et al. ..... 355/285 X
5,319,428 6/1994 Maruko et al. ..... 355/285 X
5,321,481 6/1994 Mathers ..... 355/208 X
5,448,339 9/1995 Kokaji ..... 355/208
5,508,797 4/1996 Tonai et al. ..... 355/285

*Primary Examiner*—Joan H. Pendegrass
*Assistant Examiner*—Sophia S. Chen
*Attorney, Agent, or Firm*—Beveridge, DeGrandi, Weilacher & Young LLP

[57] ABSTRACT

A fixation temperature control device is to be applied to a copying machine or the like. A control section determines a heat roller control temperature in consideration of a detected press roller temperature. When the heat roller temperature is lower than a reference temperature, a correction value is added to a heat roller reference temperature to set the heat roller control temperature higher than usual. When a fixing unit is in a stand-by status and the press roller temperature is in a temperature range between 80° C. and 90° C., a heat roller and a press roller are preferably rotated at a speed lower than a usual rotational speed.

12 Claims, 11 Drawing Sheets

FIXATION TEMPERATURE CONTROL DEVICE

CROSS REFERENCE TO RELATED APPLICATIONS

This application claims priority benefits of Japanese Patent Applications No. 7-002878 (1995) and No. 7-002879 (1995) under 35 USC § 119, the disclosures of said Japanese Patent Applications being incorporated herein by reference.

BACKGROUND OF THE INVENTION

1. Field of the Invention

The present invention relates to a fixation temperature control device for controlling a fixation temperature by controlling the power ON/OFF of a heater for heating a fixing unit, which is applied to an image forming apparatus such as an electrostatic copying machine.

2. Description of Related Arts

Recently, electrostatic copying machines capable of making a copy of a large-size document original such as of JIS AO size have become available. "JIS AO size", which is one of the sheet sizes (finished dimensions) specified by Japanese Industrial standards, is 841 mm×1189 mm.

Since it is difficult to handle large-size copy sheet such as of AO size one by one, a roll sheet is generally used which is formed of an elongated continuous sheet wound around a roll core and installed in a copying machine.

In general, an electrostatic copying machine forms a copy image of a document original on a copy sheet in the following manner. The document original is scanned under light irradiation, and a photoreceptor is exposed to light reflected on the document original, whereby an electrostatic latent image is formed on the photoreceptor. The electrostatic latent image is developed into a toner image, which is then thermally fixed on a copy sheet in a fixing unit. Thus, a copy image of the document original is formed on the copy sheet.

The fixing unit has a rubber press roller and a heat roller heated by a heater and is adapted to thermally fix the toner image on the copy sheet passing between these rollers. The fixing unit should be heated up to a predetermined temperature for thermal fixation. In accordance with a conventional fixation temperature control method, the temperature of the heat roller is controlled to approach a predetermined temperature by detecting the temperature of the heat roller and switching on and off the heater based on the detected temperature.

The fixation temperature, though controlled on the basis of the detected temperature of the heat roller, is influenced by the temperature of the press roller. If the temperature of the press roller is low, the fixation temperature excessively decreased, thereby causing fixation failure. On the other hand, if the temperature of the press roller is high, the fixation temperature is excessively increased, thereby causing a copy sheet to be wrinkled or undulated.

Particularly, where a long and wide roll sheet is used as a copy sheet, the temperature of the heat roller tends to considerably fluctuate because the heater applies a large amount of heat to the heat roller, and the roll sheet removes a large amount of heat from the heat roller at the time of toner fixation. Therefore, the fixation failure and the wrinkling of a copy sheet are more liable to occur.

SUMMARY OF THE INVENTION

It is, therefore, an object of the present invention to provide a fixation temperature control device capable of maintaining the fixation temperature in a predetermined temperature range.

According to one aspect of the present invention, to achieve the aforesaid object, there is provided a fixation temperature control device comprising:

a fixing unit of an image forming apparatus having a press roller and a heat roller heated by a heater for thermally fixing toner on a sheet passing between the press roller and the heat roller;

heat roller temperature detection means for detecting the temperature of the heat roller;

power ON/OFF control means for controlling power ON/OFF of the heater to control the temperature of the heat roller so as to allow the heat roller temperature detected by the heat roller temperature detection means to approach a predetermined control temperature, which is further comprising:

press roller temperature detection means for detecting the temperature of the press roller;

wherein the power ON/OFF control means determines the control temperature by adding to a predetermined heat roller reference temperature a correction value determined based upon the press roller temperature detected by the press roller temperature detection means.

In the present aspect, the heat roller control temperature is determined by adding to the predetermined heat roller reference temperature a correction value determined based upon the detected press roller temperature. Since the temperature of the heat roller is controlled in consideration of the temperature of the press roller, the fixation temperature can be accurately controlled to be in a preferable temperature range.

In accordance with another aspect of the present invention, the fixation temperature control device preferably further comprises driving means for rotatively driving the heat roller and the press roller, and driving control means for controlling the operation of the driving means, wherein when the press roller temperature detected by the press roller temperature detection means is lower than a predetermined temperature, the driving control means controls the driving means to rotate the heat roller and the press roller at a speed lower than a usual rotational speed upon condition that the fixing unit is in a stand-by status.

In the present aspect, in a case that the temperature of the heat roller is controlled in consideration of the temperature of the press roller, the heat roller and the press roller are rotated at a speed lower than the usual rotational speed when the temperature of the press roller is lower than the predetermined temperature and the fixing unit is in a stand-by status before starting the fixing operation. Thus, the temperatures of the heat roller and press roller are rendered substantially close to prevent the temperature of the press roller from being excessively reduced, thereby preventing excessive temperature rise of the heat roller. Accordingly, where the temperature of the heat roller is controlled in consideration of the temperature of the press roller, the wrinkling of a sheet can be prevented which would occur due to an excessively high temperature of the heat roller at the time of the toner fixation.

DETAILED DESCRIPTION OF THE PREFERRED EMBODIMENT

DESCRIPTION OF THE PREFERRED EMBODIMENTS

An embodiment of the present invention will hereinafter be described with reference to the attached drawings.

Figure 1:
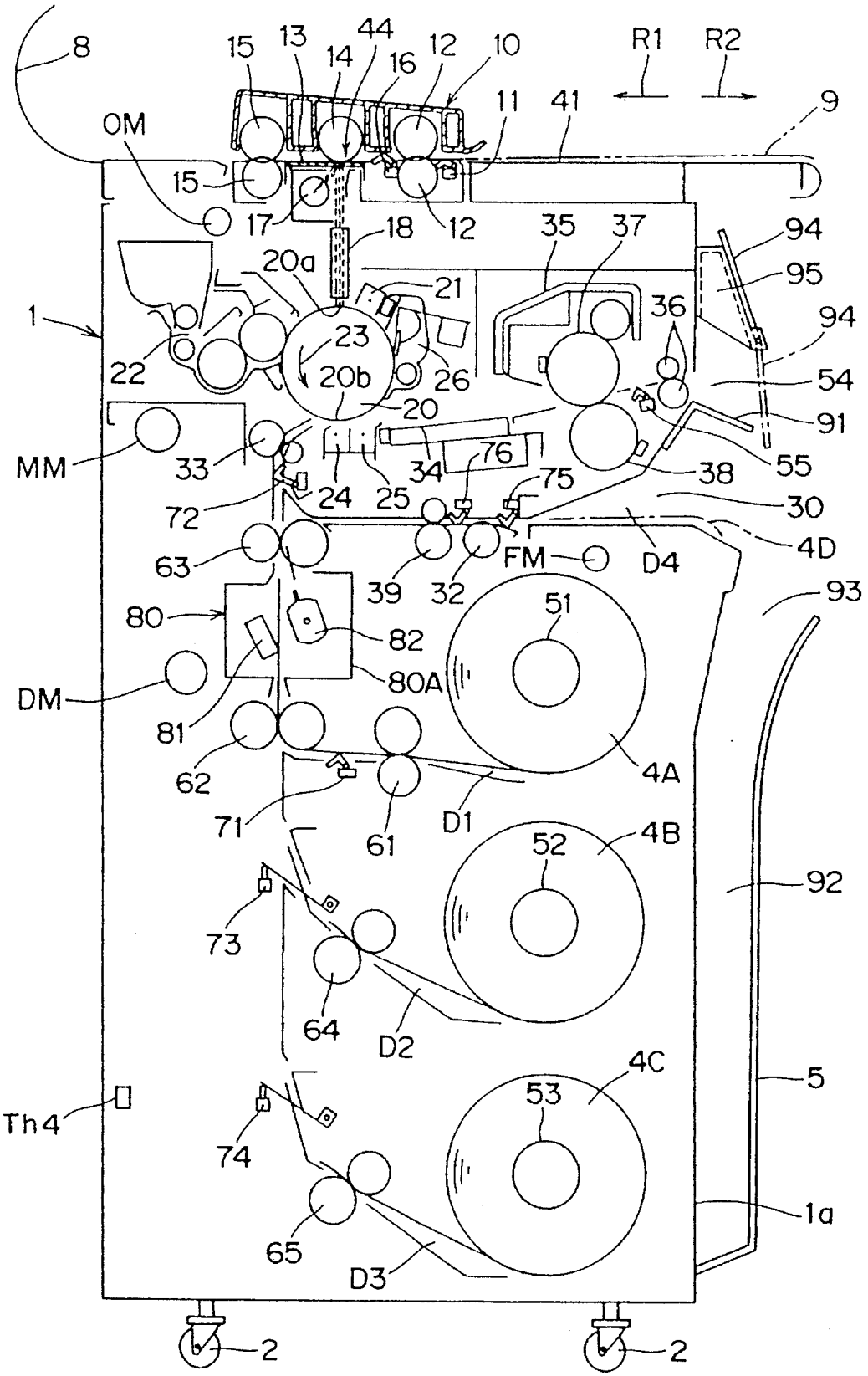
FIG. 1 is a schematic sectional view illustrating the interior construction of a copying machine to which a fixation temperature control device in accordance with one embodiment of the present invention is applied.
Figure 2:
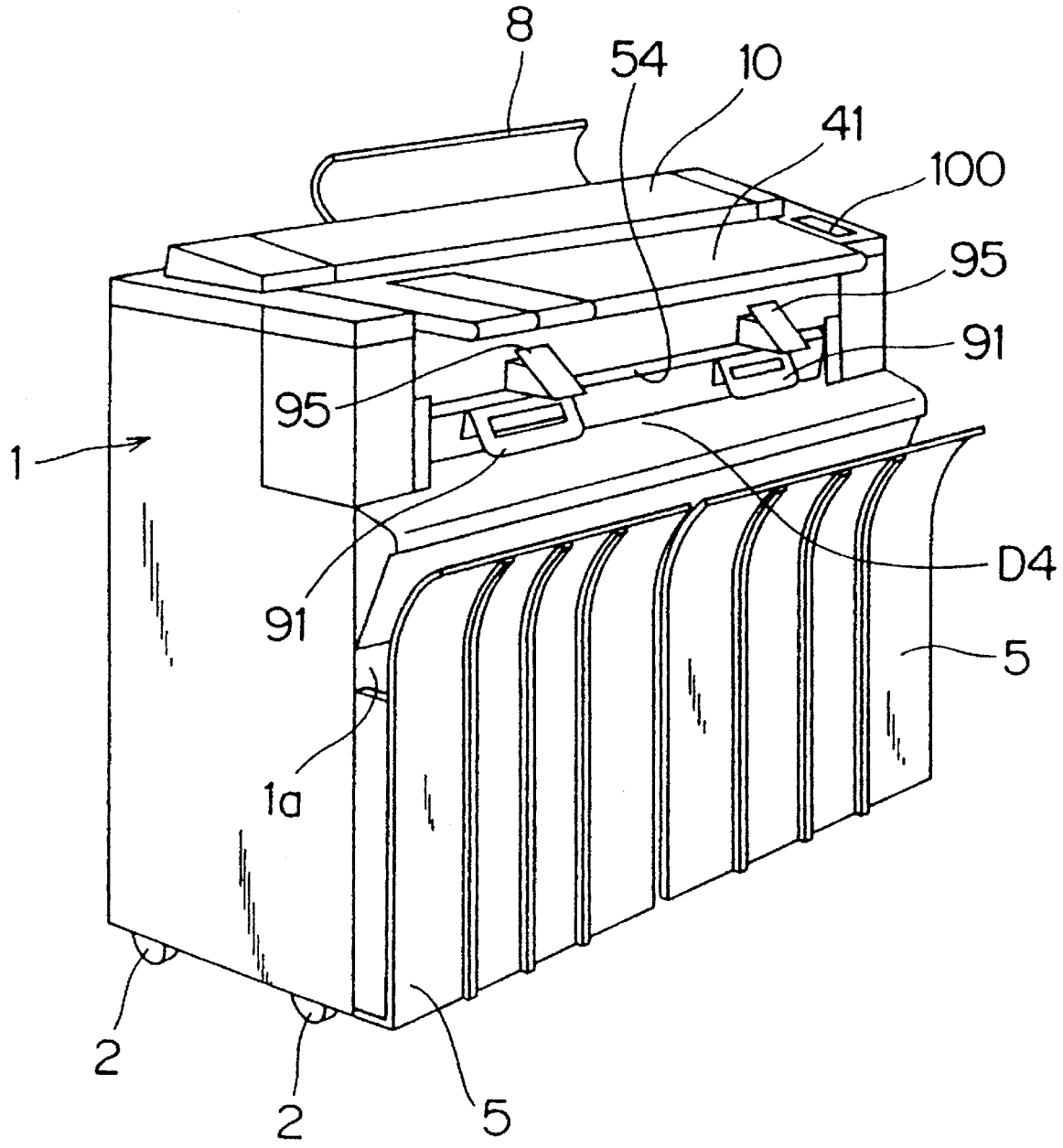
FIG. 2 is a perspective view illustrating the exterior construction of the copying machine.
Figure 3:
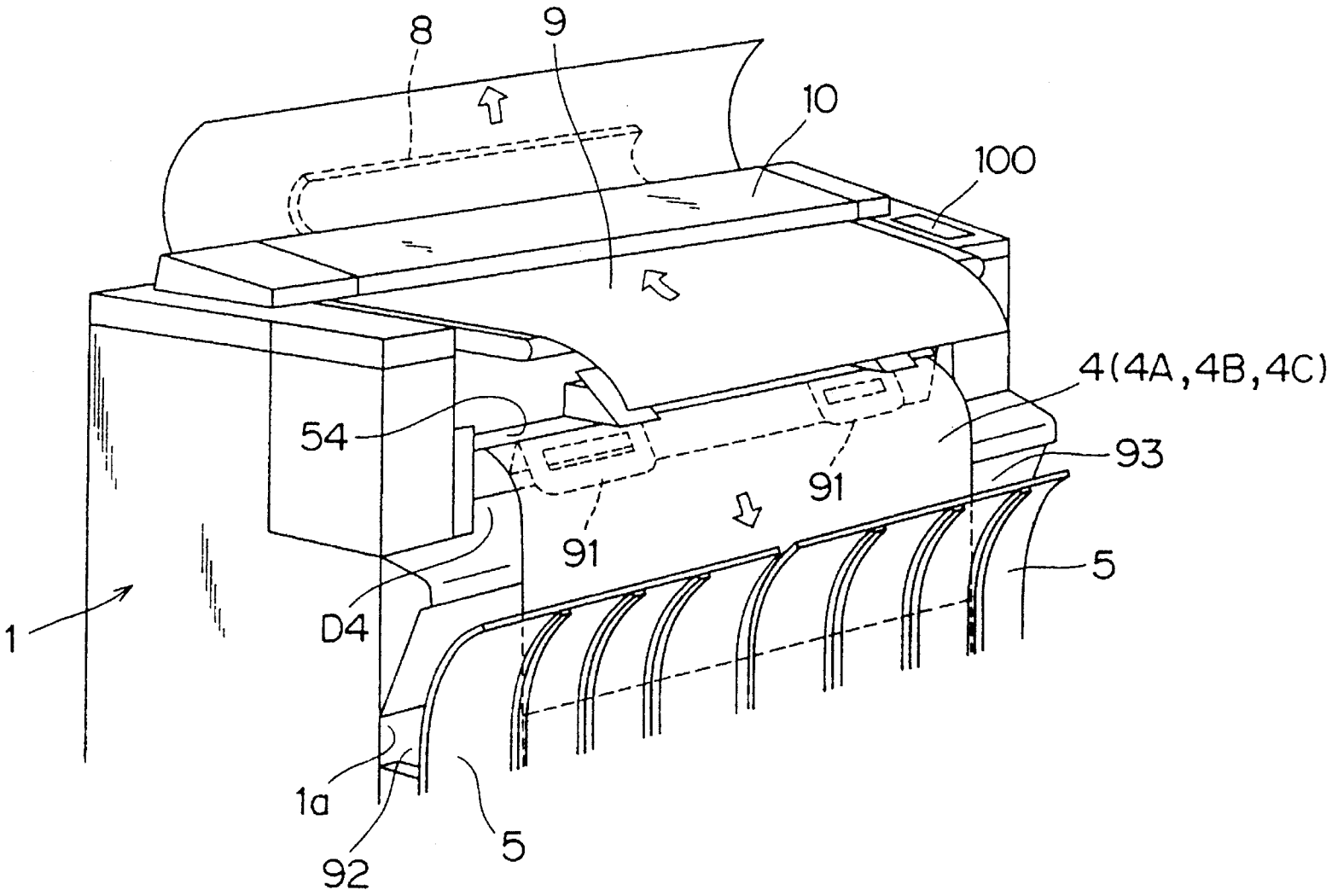
FIG. 3 is a perspective view illustrating the copying machine in its operation.

FIG. 1 is a schematic sectional view illustrating the internal construction of a copying machine in accordance with one embodiment of the present invention. FIG. 2 is a perspective view illustrating the external construction of the copying machine, and FIG. 3 is a perspective view illustrating the appearance of the copying machine which is performing a copying operation. The copying machine is adapted to obtain an image of a large-size document original such as of AO size. In the copying machine, the document original is scanned under light irradiation by a stationary optical system while being transported, and an image is formed on the basis of the optical scanning.

Referring to FIG. 1, a machine body 1 has caster wheels 2 on the under side thereof for free movement. Referring to FIGS. 1 to 3, a document-original transportation section 10 is provided on the machine body 1 for transporting a document original 9 along a document-original transportation path 41 formed on the top face of the machine body 1. A discharge port 54 for discharging a sheet having a toner image transferred thereon opens in a front face la of the machine body 1. The sheet discharged from the discharge port 54 is guided by a guide member 91, dropped through a guide opening 93 with the leading edge thereof oriented downward, and accommodated in a pocket 92 defined by a front cover 5 provided along the front face 1*a* of the machine body 1, as shown in FIG. 3. On an edge portion of the top face of the machine body 1 is provided with an operation section 100 having switches, keys and the like for making various settings related to a copying operation.

Figure 11:
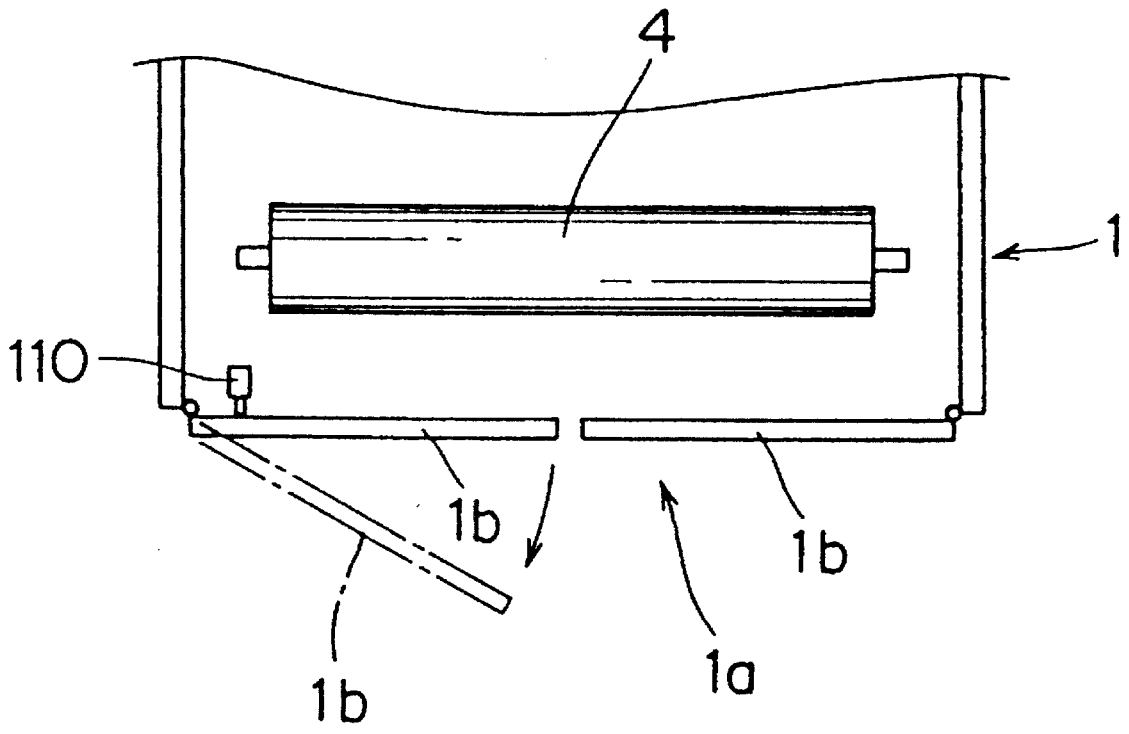
FIG. 11 is a schematic plan view illustrating the open state and close state of a front door of the copying machine.

Referring to FIG. 1, three roll sheets 4A, 4B and 4C which are located vertically in upper, middle and lower positions and each wound into a roll shape are accommodated within a portion between the vertically middle portion and the lower portion of the machine body 1. The roll sheets 4A, 4B and 4C are rolled around feed reels 51, 52 and 53, respectively. Examples of sheets to be used as these roll sheets 4A, 4B and 4C include normal paper, film and tracing paper. In the central portion of the machine body 1 is disposed a bypass transportation path D4 for feeding a cut-sheet preliminarily cut into a predetermined length such as of A0 size to A4 size through a manually sheet feeding section 30 provided on the front face 1*a* of the machine body 1. Referring to FIG. 11, at least part of the front face 1*a* of the machine body 1 is formed into a front door 1*b* which is openable for replacement of the roll sheets 4A, 4B and 4C, and a front door open/close sensor 110 for detecting the open/close state of the front door 1*b* is provided inside the machine body 1. In FIG. 11, the front cover 5 defining the pocket 92 is not shown.

The roll sheet 4A in the upper position is transported along a first transportation path D1 to a photoreceptor drum 20 through the feed reel 51, sheet feeding rollers 61, a first leading-edge detection switch 71 for detecting the leading edge of the transported roll sheet 4A, transportation rollers 62, a cutter mechanism 80, transportation rollers 63, a second leading-edge detection switch 72 for detecting the leading edge of the transported sheet 4A, 4B, 4C or 4D, and transportation rollers 33 in this order. The roll sheet 4B in the middle position is transported along a second transportation path D2 to the photoreceptor drum 20 through the feed reel 52, sheet feeding rollers 64, a third leading-edge detection switch 73 for detecting the leading edge of the transported roll sheet 4B, the transportation rollers 62, the cutter mechanism 80, the transportation rollers 63, the second leading-edge detection switch 72, and the transportation rollers 33 in this order. The transportation path downstream of the transportation rollers 62 is common to the first transportation path D1.

The roll sheet 4C in the lower position is transported along a third transportation path D3 to the photoreceptor drum 20 through the feed reel 53, sheet feeding rollers 65, a fourth leading-edge detection switch 74 for detecting the leading edge of the transported roll sheet 4C, the transportation rollers 62, the cutter mechanism 80, the transportation rollers 63, the second leading-edge detection switch 72, and the transportation rollers 33 in this order. The path downstream of the transportation rollers 62 is common to the first transportation path D1.

The bypass transportation path D4 is a path which leads the cut-sheet 4D introduced from the manually sheet feeding section 30 to the photoreceptor drum 20 through a fifth leading-edge detection switch 75 for detecting the leading edge of the transported cut-sheet, a separation roller 32 for separating cut-sheets one from another by an abut plate (not shown) abutted against the cut-sheets, a sixth leading-edge detection switch 76 for detecting the leading edge of the transported cut-sheet, resist rollers 39, the second leading-edge detection switch 72 and the transportation rollers 33 in this order. The path downstream of the second leading-edge detection switch 72 in the bypass transportation path D4 is common to the first transportation path D1.

The cutter mechanism 80 has an elongated stationary blade 81 provided in a casing 80A and extending in a direction perpendicular to a transportation direction of the roll sheet 4A, 4B or 4C, and a rotary blade 82 cooperating with the stationary blade 81 to cut the transported roll sheet 4A, 4B or 4C therebetween. The roll sheet 4A, 4B or 4C is transported upward through the cutter mechanism 80.

The document-original transportation section 10 is adapted to switch the transportation direction to either a regular direction R1 or a reverse direction R2 for the transportation of the document original 9. The image forming operation is performed when the document original is transported in the regular direction R1. When a plurality of copies are made from one document original, the document-original transportation section 10 alternates the regular transportation direction R1 and the reverse transportation direction R2 to transport the document original. The document-original transportation path 41 is provided upstream the document-original transportation section 10 with respect to the regular direction R1 on the top face of the machine body 1 and laterally projects from the top face of the machine body 1.

The document-original transportation section 10 has a first document-original edge detection switch 11, first transportation rollers 12, a second document-original edge detection switch 16, a second transportation roller 14 and third transportation rollers 15 arranged along the regular transportation direction R1 in this order.

The first transportation rollers 12 are driven in response to the detection of the leading edge (on the downstream side in the regular transportation direction R1) of the document original 9 when the first document-original edge detection switch 11 is switched on. The second transportation roller 14 facing opposite to a transparent plate 13 for exposing the document original 9 to slit light serves to press the document original 9 against the transparent plate 13. The third transportation rollers 15 serve to discharge the document original 9 after the light exposure.

The second document-original edge detection switch 16 is switched on when the document original 9 is transported therethrough in the regular transportation direction R1, thereby detecting the leading edge (with respect to the regular direction R1) of the document original 9. In response to the switch on of the second document-original edge detection switch 16, the transportation of the roll sheet 4A, 4B or 4C (hereinafter referred to simply as "roll sheet 4", the term is used to explain the copying operation) is started, thereby coordinating the transportation of the roll sheet 4 with that of document original 9.

The first document-original edge detection switch 11 is switched off after the document original 9 is transported therethrough in the regular transportation direction R1, thereby detecting the tail edge (with respect to the regular direction R1) of the document original 9. The cutter mechanism 80 is driven at a preset time point a predetermined time period after the detection of the tail edge of the document original 9 to cut the roll sheet 4. In this embodiment, the length of the transportation path extending from the cutter mechanism 80 to an image transfer position 20*b* of a corona discharger for image transfer 24 is set longer than the length of the document-original transportation path extending from the first document-original edge detection switch 11 to a document-original light-exposure position 44 by a distance between the light exposure position 20*a* of the photoreceptor drum 20 and the image transfer position 20*b*, so that the tail edge of the sheet 4 cut at the preset time point can correspond to the tail edge of the document original 9 for image formation.

The second document-original edge detection switch 16 is switched off after the document original 9 is transported therethrough in the reverse transportation direction R2, thereby detecting the tail edge of the document original 9 transported in the reverse direction R2. In response to the switch off of the second document-original edge detection switch 16, the driving of the transportation rollers 12, 14 and 15 is stopped. At this time, the leading edge of the document original 9 is held between the transportation rollers 12 for the next copying operation. A reference numeral 8 denotes a reversion member for preventing the document original 9 from dropping to the rear side of the machine body 1 by reversing the transportation direction of the document original.

A stationary light source 17 for irradiating the document surface of the document original 9 is disposed in a predetermined relation with respect to the transparent plate 13. The light from the light source 17 is emitted onto the document surface through the transparent plate 13. The light reflected on the surface of the document original 9 is led to the surface of the photoreceptor drum 20 disposed in a generally central portion of the machine body 1 by means of a selfoc lens 18. Before being exposed to the light from the selfoc lens 18, the surface of the photoreceptor drum 20 is uniformly charged by a corona discharger 21 for electrostatic charging. After the light exposure, an electrostatic latent image corresponding to a document original image is formed on the surface of the photoreceptor drum 20. The electrostatic latent image is developed into a toner image by a developing unit 22. The toner image formed on the photoreceptor drum 20 is brought into the vicinity of the corona discharger for image transfer 24, as the photoreceptor drum 20 is rotated in a direction indicated by the arrow 23.

On the other hand, the sheet 4 led to the photoreceptor drum 20 from the transportation path D1, D2 or D3 is led into the vicinity of the corona discharger for image transfer 24, and the toner image formed on the surface of the photoreceptor drum 20 is transferred onto the sheet 4 by corona discharge by means of the corona discharger for image transfer 24. The sheet 4 having the toner image transferred thereon is removed from the surface of the photoreceptor drum 20 by corona discharge by means of a corona discharger for sheet separation 25, and then led to a fixing unit 35 through a transportation path 34. In the fixing unit 35, toner is fixed onto the surface of the sheet 4 by heat-pressing the sheet 4 between a heat roller 37 and a press roller 38. The sheet 4 on which the toner is fixed is discharged out of the machine body 1 through a discharge detection switch 55 and discharge rollers 36, guided by the guide members 91, and accommodated in the pocket 92, as described above. After the toner image is transferred, the toner remaining on the surface of the photoreceptor drum 20 is removed by a cleaning unit 26 for the next electrostatic latent image formation. Similarly, the cut-sheet 4D led to the photoreceptor drum 20 from the bypass sheet feeding path D4 is subjected to the toner image transfer and the toner fixation, and then discharged into the pocket 92.

Above each of the guide members 91 is disposed an auxiliary guide plate 94. The auxiliary guide plates 94 are respectively pivotally supported by stays 95 attached to the front face 1*a* of the machine body 1. The auxiliary guide plates 94 assume either an attitude (indicated by a dashed line in FIG. 1) for guiding the discharged sheet 4 hanging down forwardly of the guide members 91 into the pocket 92 cooperatively with the guide members 91 or an attitude (indicated by a solid line in FIG. 1) for sheet accommodation in which the auxiliary guide plates 94 are respectively supported by the stays 95. The attitude of the auxiliary guide plates 94 can be shifted by the pivotal movement thereof.

Image forming means is constituted by such members as the photoreceptor drum 20, the developing unit 22 and the corona discharger 24 for image transfer. In this embodiment, the copying machine further includes a main motor MM for driving the image forming means, a sheet feeding motor DM for driving the transportation rollers for feeding the sheets 4A, 4B, 4C and 4D, a fixation motor FM serving as driving means for driving the heat roller 37 and the press roller 38 of the fixing unit 35, and a document-original feeding motor OM for driving the document original transportation section 10.

Figure 4:
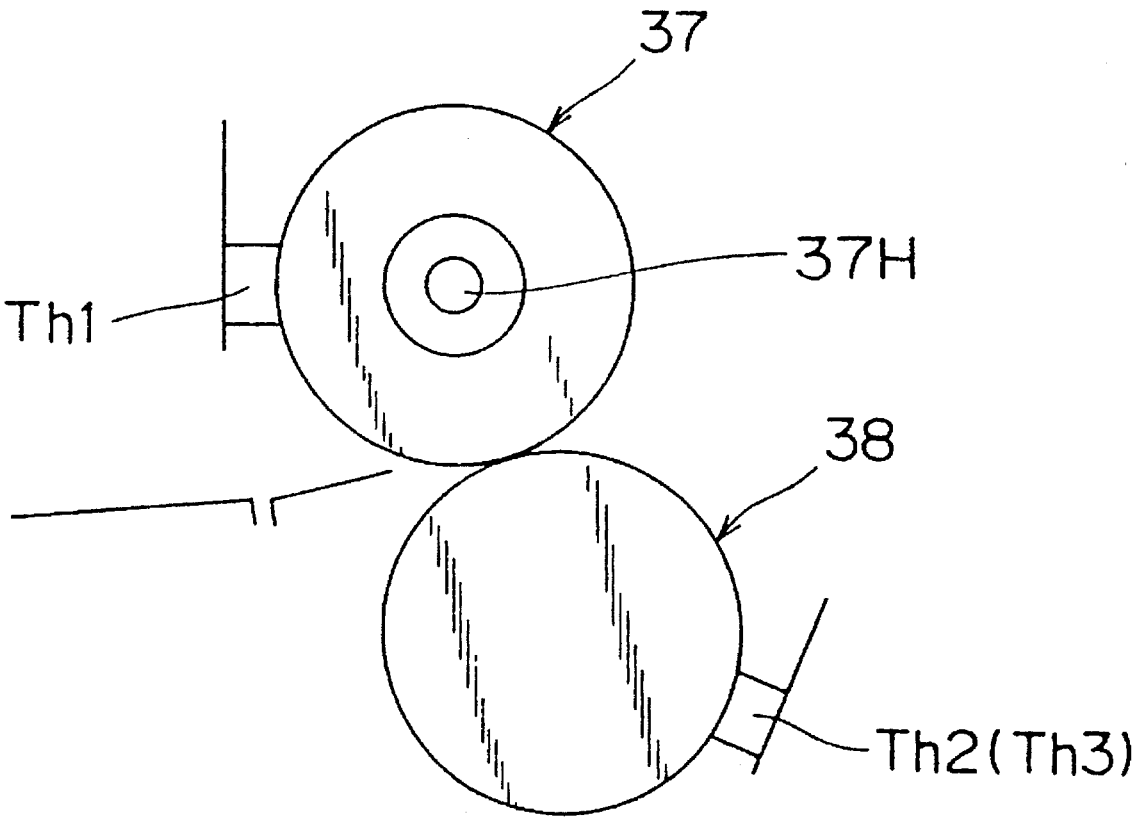
FIG. 4 is a schematic side view illustrating major portions of a fixing unit.
Figure 5:
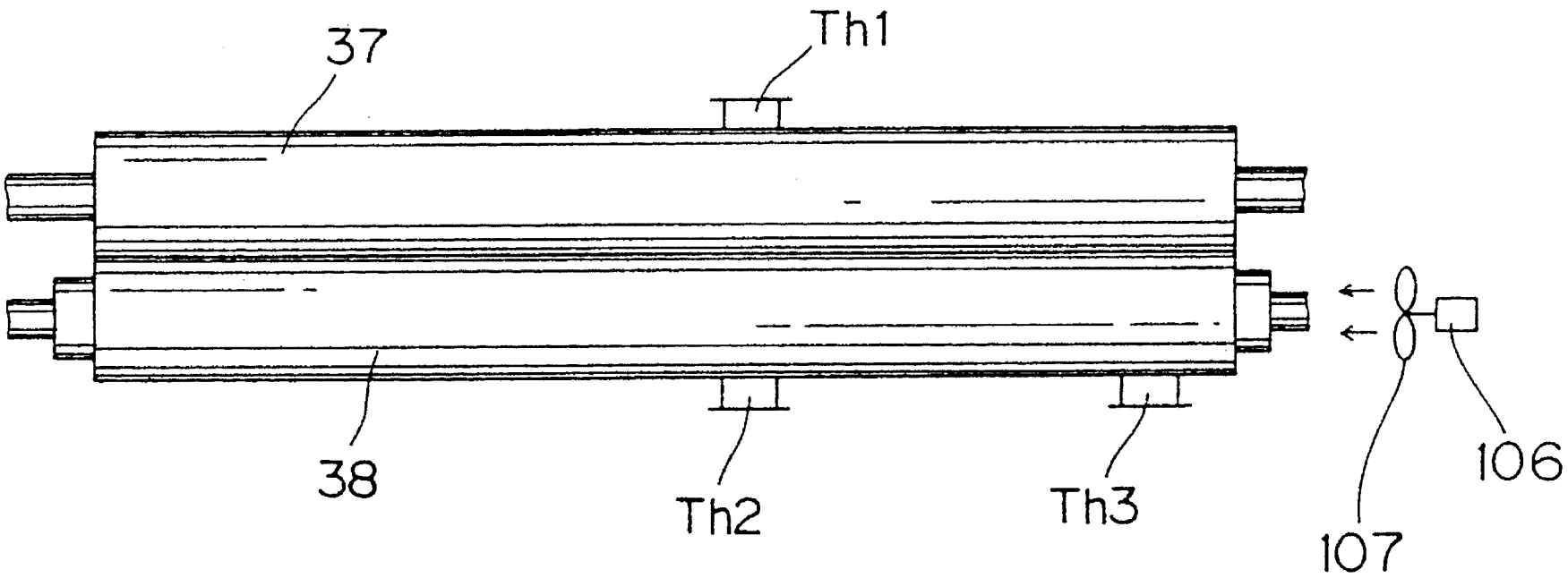
FIG. 5 is a schematic front view illustrating major portions of the fixing unit.

Referring to FIG. 4, a heater 37H for heating the heat roller 37 is incorporated in the heat roller 37. Referring to FIG. 5, a cooling fan 107 for supplying air mainly to the press roller 38 is disposed adjacent to one end of the press roller 38. The cooling fan 107 is driven by a fan motor 106. Referring to FIGS. 4 and 5(*a*), there are provided a first temperature sensor Th1 for detecting the temperature of the peripheral surface of the heat roller 37, a second temperature sensor Th2 serving as center temperature detection means for detecting the temperature of a longitudinally central portion of the peripheral surface of the press roller 38, and a third temperature sensor Th3 serving as end temperature detection means for detecting the temperature of one end portion of the peripheral surface of the press roller 38. A fourth temperature sensor Th4 for detecting the ambient temperature is provided in a position within the machine body 1 which is insusceptible to a thermal influence (see FIG. 1). The temperature sensors Th1, Th2, Th3 and Th4 each comprise a thermistor.

Figure 6:
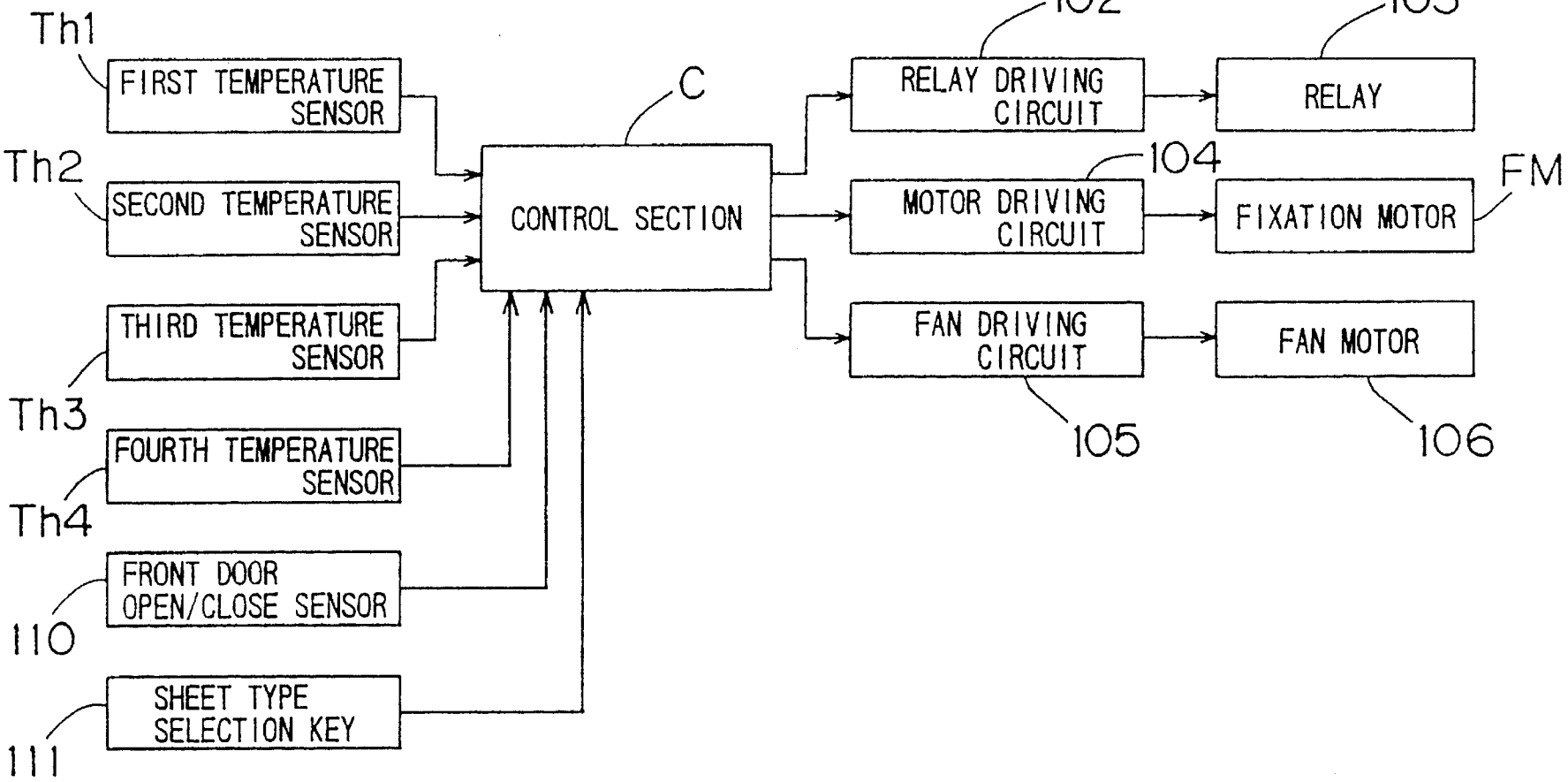
FIG. 6 is a block diagram illustrating the electrical construction of the fixation temperature control device.

Referring to FIG. 6 which is a block diagram illustrating the electrical construction of the copying machine mainly related to the fixing operation, the temperature sensors Th1, Th2, Th3 and Th4, the front door open/close sensor 110, and a sheet type selection key 111 provided on the operation section 100 (for selecting the sheet type from normal paper sheet, tracing paper sheet and film sheet respectively corresponding to the roll sheets 4A, 4B and 4C) are connected to a control section C comprising a microcomputer. Signals from the temperature sensors Th1, Th2, Th3 and Th4, the front door open/close sensor 110 and the sheet type selection key 111 are input to the control section C. Further, the control section C is connected to a relay driving circuit 102 for driving a relay 103 for switching on and off the power to the heater 37H, a motor driving circuit 104 for driving the fixation motor FM and a fan motor driving circuit 105 for driving the fan motor 106. The operations of the relay 103, fixation motor FM and fan motor 106 are controlled by the control section C.

The control section C, the relay driving circuit 102 and the relay 103 constitute power ON/OFF means, while the control section C and the motor driving circuit 104 constitute driving control means for controlling the operation of the fixation motor FM.

Figure 7:
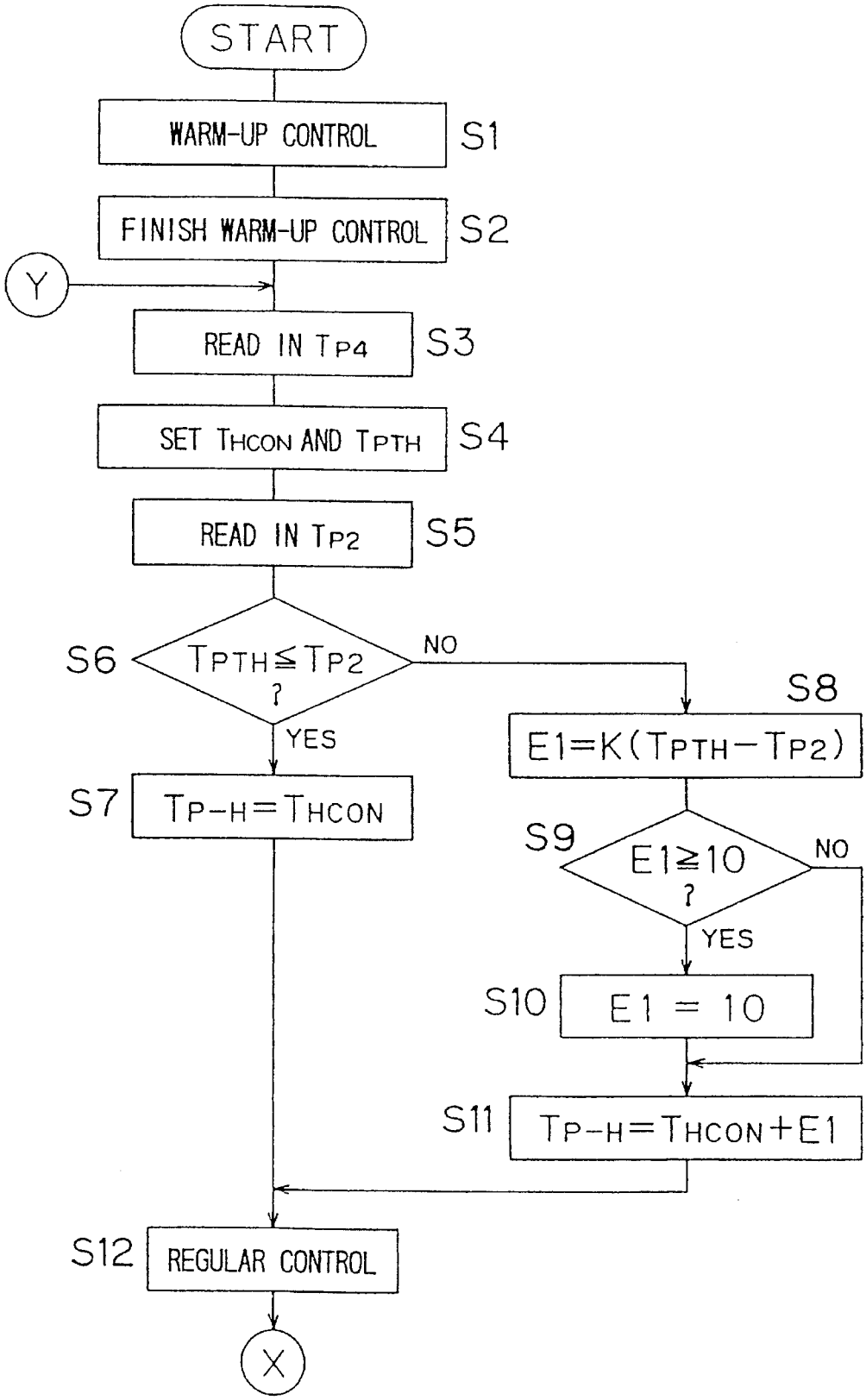
FIG. 7 is a flow chart for a fixation temperature control.
Figure 8:
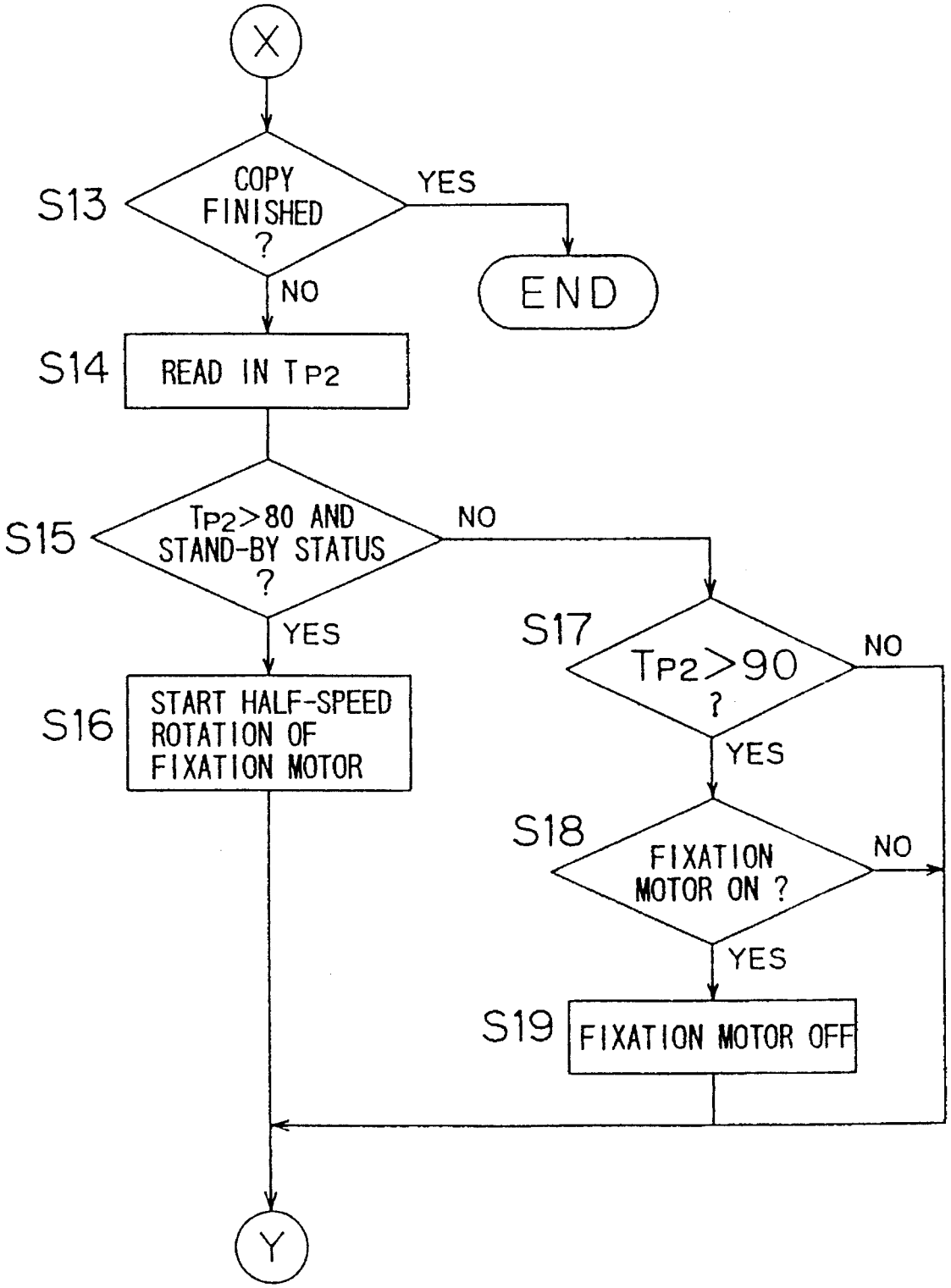
FIG. 8 is a flow chart which is a continuation of the flow chart of FIG. 7.

Referring to FIGS. 7 and 8 which are flow charts for the fixation temperature control, FIG. 9 which is a graphical representation for illustrating changes in the heat roller temperature and the press roller temperature with the lapse of time, and FIG. 10 which is a graphical representation for illustrating the correlation between the heat roller temperature and the press roller temperature, an explanation will be given to the operation of the fixation temperature control device of the present invention.

When a power supply key of the copying machine is switched on to start the operation, the power to the heater 37H is switched on to start warm-up control in which the temperature of the heat roller 37 is steadily raised to a predetermined temperature at a stretch (Step S1). In FIG. 9, the fixation motor FM is switched on at a time point t1 when the heat roller temperature reaches a predetermined primary stable temperature $T_{RDY1}$. The power to the heater 37H is first switched off at a time point t2 when the heat roller temperature reaches a predetermined secondary stable temperature $T_{RDY2}$. The warm-up control is performed till the time point t2. Though not embodied in this embodiment, the primary stable temperature $T_{RDY1}$ and the secondary stable temperature $T_{RDY2}$ may be suitably adjusted on the basis of the ambient temperature $T_{P4}$ detected by the fourth temperature sensor Th4.

When the warm-up control is completed (Step S2), the ambient temperature $T_{P4}$ detected by the fourth temperature sensor Th4 is read in as an initial temperature (Step S3).

A heat roller reference temperature $T_{HCON}$ and a press roller reference temperature $T_{PTH}$ are determined on the basis of the read-in initial ambient temperature $T_{P4}$ as shown in Table 1 (Step S4).

TABLE 1

| Ambient Temp. $T_{P4}$ (°C.) | Control Temp. $T_{HCON}$ (°C.) | Press Roller Reference Temp. $T_{PTH}$ (°C.) |
|---|---|---|
| $T_{P4} \leqq 15$ | 150 | 107 |
| $15 \leqq T_{P4} \leqq 32$ | 143 | 100 |
| $32 \leqq T_{P4}$ | 138 | 95 |

In turn, the temperature $T_{p2}$ of the central portion of the press roller 38 detected by the second temperature sensor Th2 is read in (Step S5). If it is determined in Step S6 that the temperature $T_{p2}$ of the press roller 38 is equal to or higher than the press roller reference temperature $T_{PTH}$, a control temperature $T_{P\text{-}H}$ is set to a value equal to the heat roller reference temperature $T_{HCON}$, and then a regular control is performed in which the power to the heater 37H is switched on and off on the basis of the control temperature $T_{P\text{-}H}$ (Steps S7 and S11). Referring to FIG. 9, the copying machine performs a copying operation during a time period from the time point t2 to a time point t4, and goes into a stand-by status after the time point t4. In FIG. 9, the control temperature $T_{P\text{-}H}$ is set to a value equal to the heat roller reference temperature $T_{HCON}$ (143° C.) during a time period from a time point t3 to a time point t5, during which the temperature $T_{p2}$ of the press roller 38 exceeds 100° C.

On the other hand, if it is determined in Step S6 that the detected temperature $T_{p2}$ of the press roller 38 is lower than the predetermined press roller reference temperature $T_{PTH}$, a correction value E1 is calculated by multiplying a difference ($T_{PTH} - T_{p2}$) between the press roller reference temperature $T_{PTH}$ and the temperature $T_{p2}$ of the press roller 38 by a correction factor k (for example, 0.5) (Step S8). If the calculated correction value E1 is equal to or greater than 10° C. (Step S9), a value of 10° C. is employed as the correction value E1 (Step S10). The control temperature $T_{P\text{-}H}$ is determined by adding the correction value E1 to the heat roller reference temperature $T_{HCON}$ (Step S11), and then the regular control is performed after the time point t2 shown in FIG. 9 (Step S12). As shown in FIG. 9, the control temperature $T_{P\text{-}H}$ is set higher than the heat roller reference temperature $T_{HCON}$ by the correction during time periods from the time point t2 to the time point t3 and from the time point t4 to a time point t6 during which the temperature $T_{p2}$ of the press roller 38 is lower than the press roller reference temperature $T_{PTH}$ (100° C.)

If the read-in temperature $T_{p2}$ of the press roller 38 is equal to or less than 80° C. and the fixing unit 35 is in a stand-by status (i.e., the fixation motor FM is not activated) during the regular control (Steps S14 and S15), the fixation motor FM is switched on and rotated at a speed one half a usual rotational speed (which may be an lower speed). Then, the process sequence from Step S3 to Step S15 is repeated.

When the temperature of the press roller 38 rises and the detected temperature $T_{p2}$ of the press roller 38 exceeds 90° C. during the aforesaid repetition of process sequence, the fixation motor FM if activated is stopped (Steps S15 and S17 to S19), then the process returns to Step S3, and the process sequence from Step S3 to Step S19 is repeated.

Figure 9:
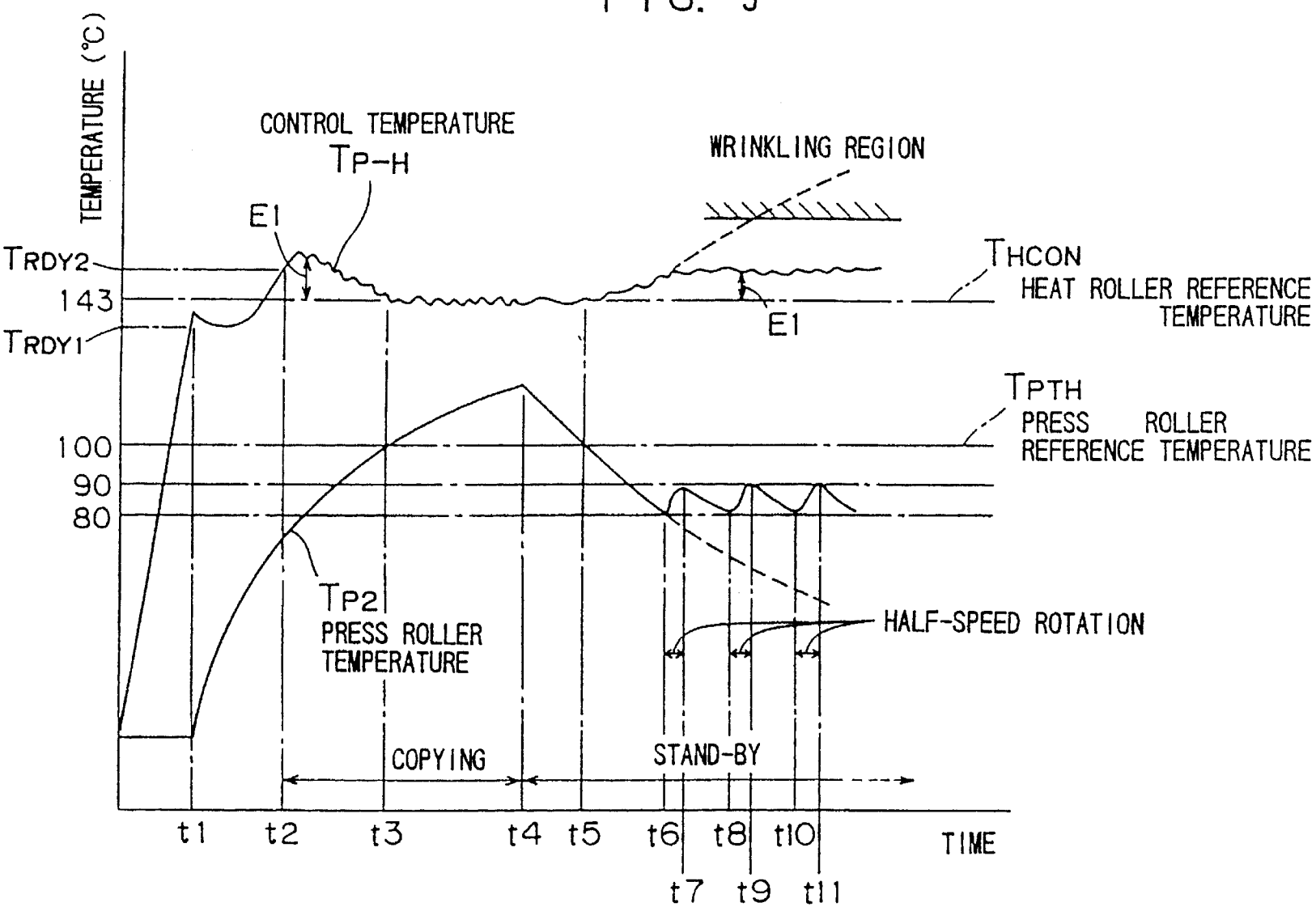
FIG. 9 is a graphical representation for illustrating changes in the heat roller temperature and the press roller temperature with the lapse of time.

Referring to FIG. 9, the temperature $T_{p2}$ of the press roller 38 is kept in a temperature range between 80° C. and 90° C. by repeating the half-speed rotation of the fixation motor FM during the time periods between the time points t6 and t7, between the time points t8 and t9, and between the time points t10 and t11. If the half-speed rotation control of the fixation motor FM is not performed, the temperature $T_{p2}$ of the press roller 38 further falls after the time point t6 as indicated by the broken line in FIG. 9. When the temperature $T_{p2}$ of the press roller 38 thus falls, the temperature $T_{p1}$ of the heat roller 37 excessively increases by the temperature correction in Step S8. Therefore, after the time point t6 the temperature $T_{p1}$ of the heat roller 37 will go into a temperature region where the wrinkling of a copy sheet may occur, as indicated by the broken line in FIG. 9. However, this phenomenon does not occur in this embodiment.

Figure 10:
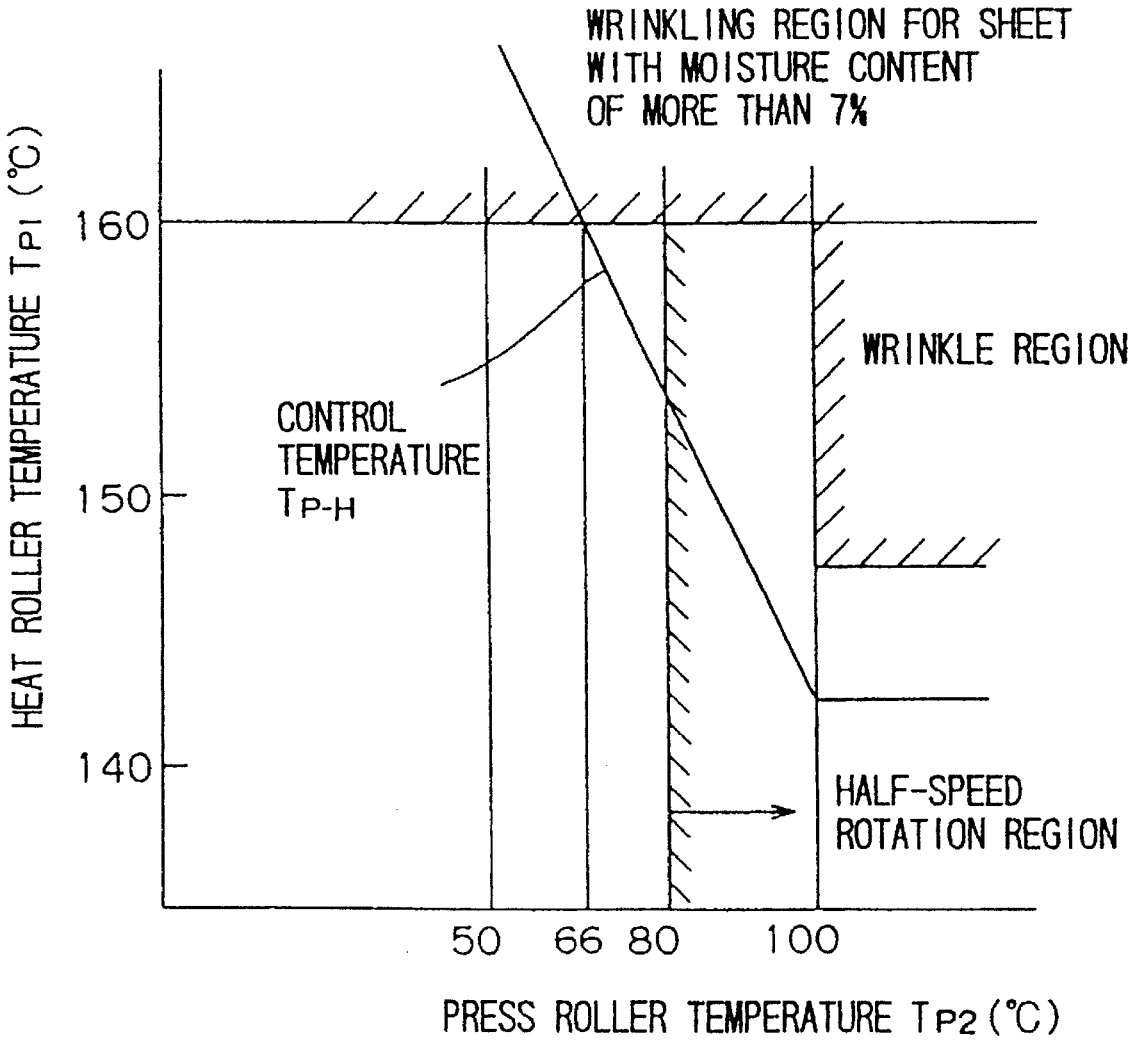
FIG. 10 is a graphical representation for illustrating a control temperature in relation to the temperatures of the heat roller and press roller.

FIG. 10 shows the control temperature $T_{P\text{-}H}$ in relation to the temperature $T_{p1}$ of the heat roller 37 and the temperature $T_{p2}$ of the press roller 38. Where the temperature $T_{p2}$ of the press roller 38 is not higher than 100° C., the temperature of the heat roller 37 is set to the control temperature $T_{P\text{-}H}$corrected in Step S8. As the temperature $T_{p2}$ of the press roller 38 decreases, the temperature $T_{p1}$ of the heat roller 37 increases. Where the temperature $T_{p2}$ of the press roller 38 is equal to or lower than 66° C., the control temperature $T_{P\text{-}H}$is not lower than 160° C. and goes into a temperature region (wrinkle region) where a normal paper sheet with a moisture content of more than 7% may be wrinkled. In this embodiment, however, the half-speed rotation control is performed to prevent the temperature $T_{p2}$ of the press roller 38 from being reduced to not higher than 80° C. and, therefore, the control temperature $T_{P\text{-}H}$ does not go into the wrinkle region for the sheet with a moisture content of more than 7%. Further, even if the temperature $T_{p1}$ of the heat roller 37 does not exceed 160° C., a temperature region where the temperature $T_{p2}$ of the press roller 38 is not lower than 100° C. and the temperature $T_{p1}$ of the heat roller 37 is not lower than 147° C. is considered to be a wrinkle region.

In this embodiment, the control temperature $T_{P\text{-}H}$ of the heat roller 38 is determined by adding to the predetermined heat roller reference temperature $T_{HCON}$ a correction value E1 which is determined on the basis of the detected temperature $T_{p2}$ of the press roller 38. That is, the temperature of the heat roller 37 is controlled in consideration of the temperature of the press roller 38 and, therefore, the fixation temperature can be accurately regulated in a predetermined preferable range.

Since the correction value E1 is determined on the basis of a difference ($T_{PTH}-T_{p2}$) between the detected temperature $T_{p2}$ of the press roller 38 and the predetermined press roller reference temperature $T_{PTH}$, the fixation temperature can be more accurately controlled.

The correction value E1 is added to the detected temperature $T_{p2}$ of the press roller 38, if the temperature $T_{p2}$ is lower than the press roller reference temperature $T_{PTH}$. That is, if the temperature $T_{p2}$ of the press roller 38 is higher than the press roller reference temperature $T_{PTH}$, the control temperature $T_{P\text{-}H}$ is not set higher and, therefore, the temperature $T_{p1}$ of the heat roller 37 is prevented from becoming excessively high. Accordingly, the wrinkling of a copy sheet can be effectively prevented.

Further, where the temperature $T_{p1}$ of the heat roller 37 is controlled in consideration of the temperature $T_{p2}$ of the press roller 38, the temperature $T_{p1}$ of the heat roller 37 may become excessively high when the temperature $T_{p2}$ of the press roller 38 is excessively low. In this embodiment, however, where the temperature $T_{p2}$ of the press roller 38 is lower than 80° C. and the fixing unit 35 is in a stand-by status before starting the fixing operation, the heat roller 37 and the press roller 38 are rotated at a speed one half the usual rotational speed and, therefore, the temperatures of the rollers 37 and 38 can be rendered substantially the same. Accordingly, the excessive rise in the temperature $T_{p1}$ of the heat roller 37 can be prevented, thereby preventing the wrinkling of a copy sheet.

In particular, when the temperature $T_{p2}$ of the press roller 38 exceeds 90° C. where the fixing unit 35 is in the stand-by status, the half-speed rotation control of the heat roller 37 and press roller 38 is stopped, so that the temperature $T_{p2}$ of the press roller 38 is lowered and kept in a temperature range between 80° C. and 90° C. This stabilizes the control temperature $T_{P\text{-}H}$ of the heat roller 37, thereby preventing a copy sheet from being wrinkled. Thus, satisfactory toner fixation can be realized.

The present invention is not limited to the aforesaid embodiment. For example, the control temperature $T_{P\text{-}H}$ can be determined by adding to the detected temperature of the heat roller the correction value E1 and another correction value E2 which is determined on the basis of the ambient temperature $T_{P4}$ detected by the fourth temperature sensor Th4. Where $T_{P4} \leqq 15°$ C., for example, the correction value E2 is set to 7° C. to set the control temperature $T_{P\text{-}H}$ higher, thereby ensuring satisfactory toner fixation. Where $T_{P4} \geqq 32°$ C., the correction value E2 is set to −5° C. to set the control temperature lower, thereby effectively preventing the wrinkling of a copy sheet.

Further, the heat roller reference temperature $T_{HCON}$ can be differently set depending on which sheet type is selected from the normal paper sheet, tracing paper sheet and film sheet by means of the sheet type selection key (not shown) provided in the operation section 100. For example, the heat roller reference temperature $T_{HCON}$ may be set to 143° C., 140° C. and 150° C. for the normal paper sheet, tracing paper sheet and film sheet, respectively. Further, the press roller reference temperature $T_{PTH}$ may be set to 100° C., 80° C. and 100° C. for the normal paper sheet, tracing paper sheet and film sheet, respectively. Thus, the fixation temperature can be controlled suitably for a selected sheet type. This improves toner fixativity and prevents the wrinkling of a copy sheet.

It should be understood that various modifications may be made without departing from the spirit and scope of the present invention, as defined in the appended claims.

What is claimed is:

1. A fixation temperature control device comprising:

a fixing unit of an image forming apparatus having a press roller and a heat roller heated by a heater for thermally fixing toner on a sheet passing between the press roller and the heat roller;

heat roller temperature detection means for detecting the temperature of the heat roller;

power ON/OFF control means for controlling power ON/OFF of the heater to control the temperature of the heat roller so as to allow the heat roller temperature detected by the heat roller temperature detection means to approach a predetermined control temperature; and press roller temperature detection means for detecting the temperature of the press roller;

wherein the power ON/OFF control means determines the control temperature by adding to a predetermined heat roller reference temperature a correction value determined based upon the temperature of the press roller detected by the press roller temperature detection means.

2. A fixation temperature control device as set forth in claim 1, wherein the correction value is determined based upon a comparison of the temperature of the press roller detected by the press roller temperature detection means with a predetermined press roller reference temperature.

3. A fixation temperature control device as set forth in claim 2, wherein the correction value is determined based upon a difference between the temperature of the press roller detected by the press roller temperature detection means and the predetermined press roller reference temperature.

4. A fixation temperature control device as set forth in claim 1, wherein the correction value is added to the predetermined heat roller reference temperature upon condition that the temperature of the press roller detected by the press roller temperature detection means is lower than the press roller reference temperature.

5. A fixation temperature control device as set forth in claim 1, further comprising ambient temperature detection means for detecting an ambient temperature around the fixing unit, wherein the power ON/OFF control means determines the press roller reference temperature based upon the ambient temperature detected by the ambient temperature detection means.

6. A fixation temperature control device as set forth in claim 1, further comprising ambient temperature detection means for detecting an ambient temperature around the fixing unit, wherein the power ON/OFF control means determines the control temperature based upon the ambient temperature detected by the ambient temperature detection means.

7. A fixation temperature control device as set forth in claim 1, wherein the press roller reference temperature is respectively determined based upon types of sheets on which toner is to be fixed.

8. A fixation temperature control device as set forth in claim 1, further comprising sheet type selection means, wherein the power ON/OFF control means determines the press roller reference temperature based upon a sheet type selected by the sheet type selection means.

9. A fixation temperature control device as set forth in claim 1, further comprising:

driving means for rotatively driving the heat roller and the press roller; and driving control means for controlling the operation of the driving means;

wherein, when the temperature of the press roller detected by the press roller temperature detection means is equal to or lower than a predetermined temperature, the driving control means controls the driving means to rotate the heat roller and the press roller at a speed lower than a usual rotational speed upon condition that the fixing unit is in a stand-by status.

10. A fixation temperature control device as set forth in claim 9, wherein the predetermined temperature is 90° C.

11. A fixation temperature control device as set forth in claim 1, further comprising:

driving means for rotatively driving the heat roller and the press roller; and driving control means for controlling the operation of the driving means;

wherein, when the temperature of the press roller is in a temperature range between a predetermined first temperature and a predetermined second temperature higher than the first temperature, the driving control means controls the driving means to rotate the heat roller and the press roller at a speed lower than a usual rotational speed upon condition that the fixing unit is in a stand-by status.

12. A fixation temperature control device as set forth in claim 11, wherein the first temperature is 80° C. and the second temperature is 90° C.

* * * * *